US008728259B1

(12) United States Patent
Hordos et al.

(10) Patent No.: US 8,728,259 B1
(45) Date of Patent: May 20, 2014

(54) GAS GENERATOR

(75) Inventors: Deborah L. Hordos, Troy, MI (US); Slaven Domazet, Sterling Heights, MI (US); Brian A. Mayville, Troy, MI (US)

(73) Assignee: TK Holdings Inc., Armada, MI (US)

( * ) Notice: Subject to any disclaimer, the term of this patent is extended or adjusted under 35 U.S.C. 154(b) by 139 days.

(21) Appl. No.: 12/587,051

(22) Filed: Sep. 30, 2009

Related U.S. Application Data

(60) Provisional application No. 61/194,873, filed on Sep. 3, 2008.

(51) Int. Cl.

| | |
|---|---|
| ***C06B 31/00*** | (2006.01) |
| ***C06B 31/02*** | (2006.01) |
| ***C06B 31/08*** | (2006.01) |
| ***D03D 23/00*** | (2006.01) |
| ***D03D 43/00*** | (2006.01) |

(52) U.S. Cl.
USPC ..... 149/61; 149/45; 149/70; 149/108.4; 149/109.2; 149/109.4

(58) Field of Classification Search
USPC ..... 149/61, 45, 70, 108.4, 109.2, 109.4
See application file for complete search history.

(56) References Cited

U.S. PATENT DOCUMENTS

| | | | | |
|---|---|---|---|---|
| 3,749,024 | A * | 7/1973 | Pakulak, Jr. | 101/101 |
| 5,445,078 | A * | 8/1995 | Marion | 102/505 |
| 6,176,950 | B1 * | 1/2001 | Wood et al. | 149/19.1 |
| 2001/0020504 | A1 * | 9/2001 | Knowlton et al. | 149/36 |
| 2006/0219340 | A1 * | 10/2006 | Dunham et al. | 149/19.7 |

* cited by examiner

*Primary Examiner* — James McDonough
(74) *Attorney, Agent, or Firm* — L. C. Begin & Associates, PLLC.

(57) ABSTRACT

An inflator 10 is provided whereby the interstitial cavities found within the inflator 10 are packed with one or more decomposition additives 26 that decompose in the presence of heat. As such, the decomposition additives 26 fluidly and/or conductively communicate with the hot gases generated upon activation of the inflator 10. As the decomposition additive 26 decomposes, heat may be mitigated while resultant gaseous decomposition products are liberated.

16 Claims, 2 Drawing Sheets

GAS GENERATOR

CROSS REFERENCE TO RELATED APPLICATIONS

This application claims the benefit of provisional application Ser. No. 61/194,873, filed on Sep. 30, 2008.

BACKGROUND OF THE INVENTION

The present invention relates generally to gas generating systems and, more particularly, to gas generators used in vehicle occupant protection systems. It is contemplated that the present invention may also be useful in other gas generating contexts such as inflatable rafts for example.

Certain known gas generators utilize pyrotechnic gas generating compositions that when combusted produce inflating gases to actuate or inflate airbags, cushions, curtains, and other vehicle safety equipment such as seatbelt pretensioners.

With the advent of non-azide compositions, or azide-free compositions, there is a greater need for cooling the effluent gases of the gas generator given that non-azide compositions typically combust at relatively greater temperatures as compared to azide-based compositions. Accordingly, filters and/or heat sinks have been typically employed to manage both filtration of solids in the gaseous effluent, and, cooling of the effluent gases as the heat of the gases is exchanged with the cooler filter or heat sink. One drawback with the use of filters or heat sinks is the relative increase in mass or weight of the gas generator. Filters are typically formed from roll-formed woven metal, for example, and constitute a large percentage of the overall mass of the gas generator or inflator.

A reduction in the mass of the gas generator, and a reduction in the overall size of the inflator, without sacrificing the total gaseous output, would therefore be an improvement in the art given the packaging benefits, and given the reduction in manufacturing complexity and cost. The current challenge, therefore, is to optimize the filtration and cooling requirements thereby obviating or mitigating the need for the typical robust filter designs.

SUMMARY

The present invention reconciles the concerns addressed above by providing a novel approach to generating gases and cooling the effluent gases within a gas generator. In accordance with the present invention, any known gas generating composition that provides relatively high heat per gram of gas generant combusted is considered useful in the present context. Accordingly, those compositions that are known to exhibit good ignitability and high heat upon combustion are preferred.

Again, although other compositions may be used, an exemplary gas generating composition in accordance with the present invention includes a primary fuel, a salt of tetrazole, a metallic oxidizer, and a catalyst. An acidic and aromatic primary fuel may be provided that is selected from a tetrazole such as 5-aminotetrazole; a benzene-based fuel such as dinitrobenzoic acid, dinitrobenzamide; and nitroisophthalic acid; and mixtures thereof. The primary fuel is generally provided at about 1-50 wt % of the total composition.

The composition may also contain an aromatic or non-aromatic basic constituent that is selected from amino compounds, salts of amino compounds, alkali metal salt such as a salt of tetrazole is selected from alkali metal salts including potassium 5-aminotetrazole and sodium 5-aminotetrazole, a potassium salt of an aromatic or benzene-based salt such as potassium dinitrobenzoate, and mixtures thereof. The basic constituent is generally provided at about 1-50 wt % of the total composition.

An oxidizer may be selected from metal oxidizers including alkali metal oxidizers such as potassium nitrate, sodium nitrate, and mixtures thereof. The metallic oxidizer is generally provided at about 35-75 wt % of the total composition.

An additive may be provided from catalytic non-oxidizing molybdenum-containing constituents including powdered molybdenum, molybdenum trioxide, and mixtures thereof. The catalyst is generally provided at about 1-10 wt % of the total composition.

The gas generating composition is loaded in a gas generator in a known manner, and constitutes a primary heat source. In accordance with the present invention, a discrete and separate additive, in the form of a compound or composition, is sprinkled or distributed about the interstitial cavities within the gas generator, and/or, about the gas generating composition. In accordance with the present invention, the additive is separate from the gas generating composition, and does not constitute a fraction or portion of the gas generating composition. Furthermore, the additive is selected and optimized to ensure that it decomposes rather than combusts at the combustion temperatures attendant to the combustion of the gas generating composition, and, that it advantageously liberates generous amounts of gas upon decomposition thereof.

DETAILED DESCRIPTION OF THE INVENTION

Figure 1:
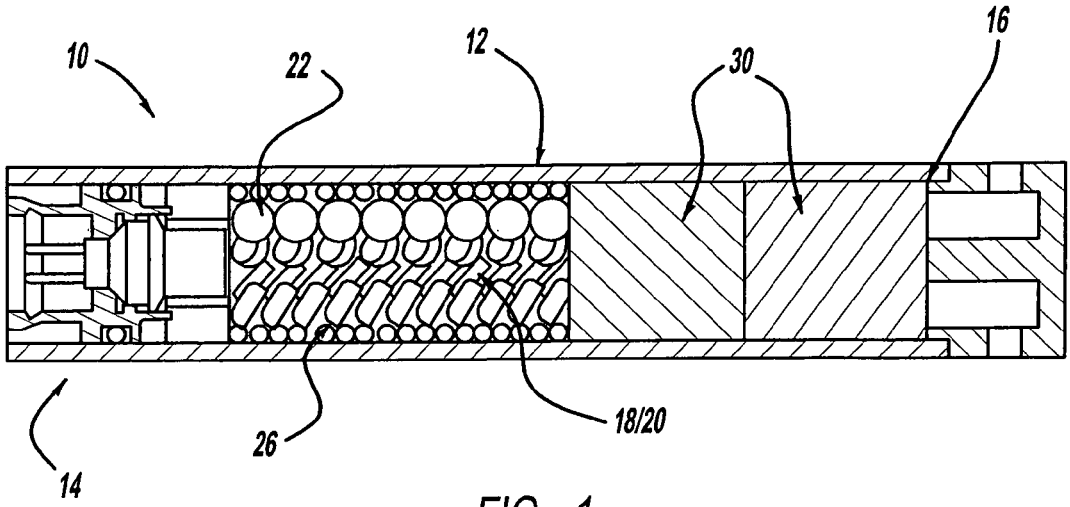
FIG. 1 is a cross-sectional view of an inflator assembly in accordance with the present invention.

FIG. 1 illustrates an exemplary embodiment of a gas generator 10 in accordance with the present invention. A housing 12 has a first end 14 and a second end 16, and defines a combustion chamber 18 and a decomposition chamber 20. As shown in the figures, the combustion chamber 18 may be the same as the decomposition chamber 20, or, the combustion chamber 18 and the decomposition chamber 20 may be physically separate. Regardless of the orientation of the chambers, the combustion chamber 18 must thermodynamically communicate with the decomposition chamber 20. Thermodynamic communication may occur through direct contact with the combustion gases, and/or, through conductive contact with adjacent surfaces of each chamber.

A gas generating composition 22, preferably also having auto-ignition and booster functionality, is housed within the combustion chamber 18. An igniter 24 is fixed in a known manner at the first end 14, and upon actuation thereof, combustion of gas generant 22 is initiated. As shown in FIG. 1, a decomposition material 26 is proximately situated or juxtaposed to gas generating composition 22, within decomposition chamber 20, thereby ensuring thermodynamic communication with the heat of combustion of gas generating composition 22. Stated another way, decomposition material 26 may be separated from gas generating composition 22, but in thermodynamic communication therewith. Alternatively, decomposition material 26 may be sprinkled or distributed within the gas generating composition bed 28, in proximate but discrete relationship to gas generating composition 22. As shown in the Figures, composition 22 and material 26 may be juxtaposed to each other as the material 26 is distributed within the interstitial cavities formed about the composition 22, but not combined within composition 22.

A filter 30 may be oriented proximate to, or radially about the chambers 18 and/or 20, thereby providing a heat sink and filtration means for gases exiting the housing 12. Stated another way, the filter is in gaseous communication with chambers 18 and/or 20 thereby cooling and filtering the combustion and decomposition gases prior to emission from the gas generator 10. One or more apertures 32 are positioned within gas generator 10, or housing 12, thereby providing an exit path for gases produced upon actuation of the gas generator 10.

It will be appreciated that the decomposition material 26 is selected to decompose at or below the combustion temperature of the composition 22. More particularly, it is believed that the thermodynamic relationship between the gas generant 22 and the decomposition material 26 may be described as provided in equation (1):

$$H_c = H_f + H_d \quad (1)$$

wherein $H_c$ is the heat of combustion in kcal/mol of gas generant 22, $H_f$ is the heat of fusion (melting) in kcal/mol of the material 26, and $H_d$ is the heat of decomposition in kcal/mol of the material 26. These various heats may be iteratively determined to optimize the quantities of any gas generant 22 and any decomposition material 26 to be provided within the gas generator 10, by thermocouple measurement for example. Alternatively, these various heats may be found within known publications such as any recent edition of the *CRC Handbook of Chemistry and Physics*, or *Perry's Chemical Engineer's Handbook*.

An appreciation of the thermodynamic heat balance of equation (1) is necessary to optimize the total amount of gas generant 22 required to liberate the desired amount of gases from the decomposition material 26, while yet minimizing the heat output during the decomposition reaction, and therefore minimizing the heat management necessary relative to heat exiting the chambers 18 and 20. When calculating the total mols of gas necessary for any given application, to inflate a driver-side airbag for example, the equation given below is useful:

$$\text{Mols of Combustion} + \text{Mols of Decomposition} = \text{Mols of Gas} \quad (2)$$

Accordingly, the mols of gas necessary to inflate an airbag may be iteratively determined as per known design requirements, and as per normal design protocol. When the amount of gas necessary is known, then the amount of gas generant 22 and the amount of decomposition material 26 may be readily determined.

THEORETICAL EXAMPLE 1

Calculation of Gas Generant and Decomposition Material

For a given application, it is desired to produce at least 18 mols of gas output from a known gas generator, upon combustion of a predetermined amount of a gas generant. When combusted, a gas generant is known to produce 4 mols of gas per mol of gas generant. With regard to heat, each mol of gas generant is also known to liberate 18 kcal/mol upon combustion thereof. Ammonium nitrate is provided as a decomposition material. Ammonium nitrate has a heat of fusion of +18.2 kcal/mol (endothermic or heat consuming), and a heat of decomposition of about −8 kcal/mol (exothermic or heat releasing). Ammonium nitrate also liberates 3 mols of gas upon decomposition. One mol of gas generant described in this example produces 18 kcal of heat, and because the heat of fusion of ammonium nitrate requires 18 kcal of heat to bring the ammonium nitrate to its melting or fusion point (endothermic), it can be determined that one mol of gas generant actually provides the necessary heat to heat the decomposition material to the melting point. At that point, about 8.2 kcal of heat are released exothermically upon decomposition. Accordingly, it can be seen that in this example one mol of gas generant produces 4 mols of combustion gas, and liberates 3 mols of decomposition gas. As such, to produce at least 18 mols of gas generated, the relationship of total gas generated per mol of gas generant is 7 mols of gas generated to 1 mol of gas generant. Accordingly, in the context of this example, about 2.57 mols of gas generant, and about 2.57 mols of ammonium nitrate would be required to generate about 18 mols of gas.

It will be appreciated that for any desired amount of gas to be produced, and in view of the variables such as the heat of combustion of a gas generant, the total mols of gas produced upon combustion of a gas generant, the heats of fusion and decomposition of a decomposition material, and the total mols of gas produced upon decomposition of the decomposition material, the total amounts of gas generant and decomposition material can be calculated using equations (1) and (2).

Various gas generants 22 may be employed in accordance with the present invention. For example, co-owned U.S. Pat. Nos. 5,035,757 and 6,210,505, herein incorporated by reference in their entirety, may be utilized to provide the necessary heat to decompose the decomposition material 26 into its gaseous products.

EXAMPLE 2

Exemplary Gas Generating Composition

An exemplary gas generant 22 includes a primary fuel, a salt of tetrazole, a metallic oxidizer, and a catalyst. An acidic and aromatic primary fuel may be provided that is selected from a tetrazole such as 5-aminotetrazole; a benzene-based fuel such as dinitrobenzoic acid, dinitrobenzamide; and nitroisophthalic acid; and mixtures thereof. The primary fuel is generally provided at about 1-50 wt % of the total composition.

The composition may also contain an aromatic or non-aromatic basic constituent that is selected from amino compounds, salts of amino compounds, alkali metal salt such as a salt of tetrazole is selected from alkali metal salts including potassium 5-aminotetrazole and sodium 5-aminotetrazole, a potassium salt of an aromatic or benzene-based salt such as potassium dinitrobenzoate, and mixtures thereof. The basic constituent is generally provided at about 1-50 wt % of the total composition.

An oxidizer is selected from metal oxidizers including alkali metal oxidizers such as potassium nitrate, sodium nitrate, and mixtures thereof. The metallic oxidizer is generally provided at about 35-75 wt % of the total composition.

An additive is selected from catalytic non-oxidizing molybdenum-containing constituents including powdered molybdenum, molybdenum trioxide, and mixtures thereof. The catalyst is generally provided at about 1-10 wt % of the total composition.

EXAMPLE 3

A gas generating composition 22 was formed as described in U.S. Pat. No. 6,210,505. Ammonium nitrate was provided as a decomposition material. An inflator 10 constructed as shown in FIG. 1 was charged with 25 grams of the gas generating composition and with 8 grams of the ammonium nitrate by simply scattering and dispersing the ammonium nitrate about the gas generant bed, thereby commingling the composition 22 and the ammonium nitrate in a heterogeneous manner. The inflator 10 was actuated within a 60 L tank and pressure curves over time were evaluated. The chamber pressure peaked at 64.6 MPa in 8.0 ms, with a time to first gas measured to be 3.2 ms. The tank pressure at 10 ms was measured to be 137.3 kPa. The tank pressure at 20 ms. was measured to be 244.8 kPa. At 45.3 ms, the tank pressure was measured to be 313.8 kPa.

EXAMPLE 4

A gas generating composition 22 was formed as described in co-owned U.S. Pat. No. 6,210,505. Ammonium nitrate was provided as a decomposition material. An inflator 10 constructed as shown in FIG. 1 was charged with 17 grams of the gas generating composition and with 8 grams of the ammonium nitrate by simply scattering and dispersing the ammonium nitrate about the gas generant bed, thereby commingling the composition 22 and the ammonium nitrate in a heterogeneous manner. The inflator 10 was actuated within a 60 L tank, and pressure curves over time were evaluated. The chamber pressure peaked at 33.0 MPa in 7.0 ms, with a time to first gas measured to be 3.7 ms. The tank pressure at 10 ms. was measured to be 61.5 kPa. The tank pressure at 20 ms. was measured to be 122 kPa. At 47.7 ms, the tank pressure was measured to be 176.8 kPa. As compared to example 3, this example illustrates that tailoring the amount of gas generant results in a direct correlation to the amount of gas produced, and yet, the overall temperature of the gas is reduced (ideal gas law) thereby mitigating cooling requirements of the gas output.

EXAMPLE 5

Figure 4:
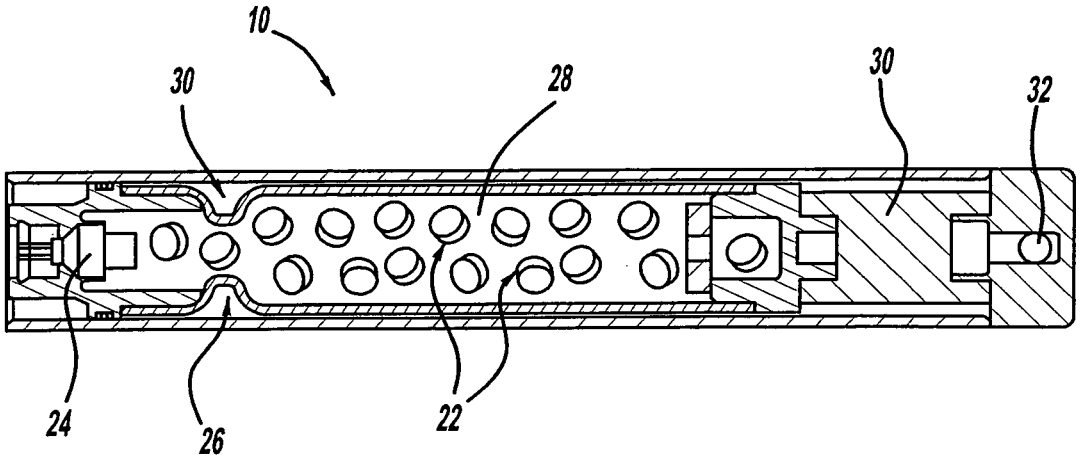
FIG. 4 is a cross-sectional view of a third embodiment of the inflator assembly in accordance with the present invention.

A gas generating composition 22 was formed as described in co-owned U.S. Pat. No. 6,210,505. Ammonium nitrate was provided as a decomposition material. An inflator 10 constructed as shown in FIG. 4 was charged with 25 grams of the gas generating composition within a combustion chamber 18 and with 8 grams of the ammonium nitrate within an adjacent plenum 30 (decomposition chamber). The inflator 10 was actuated within a 60 L tank and pressure curves over time were evaluated. The ammonium nitrate was conductively decomposed upon ignition of the gas generant. The chamber pressure peaked at 47.1 MPa in 10.4 ms, with a time to first gas measured to be 4.1 ms. The tank pressure at 10 ms was measured to be 78.5 kPa. The tank pressure at 20 ms. was measured to be 168.1 kPa. At 49.5 ms, the tank pressure was measured to be 256.7 kPa.

EXAMPLE 6

A gas generating composition 22 was formed as described in U.S. Pat. No. 6,210,505. Ammonium nitrate was provided as a decomposition material. An inflator 10 constructed as shown in FIG. 1 was charged with 20 grams of the gas generating composition and with 8 grams of the ammonium nitrate by simply scattering and dispersing the ammonium nitrate about the gas generant bed, thereby commingling the composition 22 and the ammonium nitrate in a heterogeneous manner. The inflator 10 was actuated within a 60 L tank and pressure curves over time were evaluated. The chamber pressure peaked at 39.3 MPa in 9.9 ms, with a time to first gas measured to be 3.3 ms. The tank pressure at 10 ms. was measured to be 75.5 kPa. The tank pressure at 20 ms. was measured to be 153.7 kPa. At 49.4 ms, the tank pressure was measured to be 224.7 kPa.

EXAMPLE 7

A gas generant is formed as provided in example 2. Ammonium nitrate was provided as a decomposition material. An inflator 10 constructed as shown in FIG. 1 was charged with 5.7 grams of the gas generating composition and with 3.8 grams of the ammonium nitrate by simply scattering and dispersing the ammonium nitrate about the gas generant bed, thereby commingling the composition 22 and the ammonium nitrate in a heterogeneous manner. The inflator 10 was actuated within a 60 L tank and pressure curves over time were evaluated. The total amount of gas produced was 0.3 mols of gas. The tank pressure was about 190 kPa at 15 ms.

EXAMPLE 8

A gas generant is formed as provided in example 2. Ammonium nitrate was provided as a decomposition material. An inflator 10 constructed as shown in FIG. 1 was charged with 5.0 grams of the gas generating composition and with 4.2 grams of the ammonium nitrate by simply scattering and dispersing the ammonium nitrate about the gas generant bed, thereby commingling the composition 22 and the ammonium nitrate in a heterogeneous manner. The inflator 10 was actuated within a 60 L tank and pressure curves over time were evaluated. The total amount of gas produced was 0.3 mols of gas. The tank pressure was about 175 kPa at 15 ms.

EXAMPLE 9

A gas generant is formed as provided in example 2. Ammonium nitrate was provided as a decomposition material. An inflator 10 constructed as shown in FIG. 1 was charged with 4.5 grams of the gas generating composition and with 4.5 grams of the ammonium nitrate by simply scattering and dispersing the ammonium nitrate about the gas generant bed, thereby commingling the composition 22 and the ammonium nitrate in a heterogeneous manner. The inflator 10 was actuated within a 60 L tank and pressure curves over time were evaluated. The total amount of gas produced was 0.3 mols of gas. The tank pressure was about 160 kPa at 15 ms.

EXAMPLE 10

A gas generant is formed as provided in example 2. Ammonium nitrate was provided as a decomposition material. An inflator 10 constructed as shown in FIG. 1 was charged with 4.0 grams of the gas generating composition and with 4.7 grams of the ammonium nitrate by simply scattering and dispersing the ammonium nitrate about the gas generant bed, thereby commingling the composition 22 and the ammonium nitrate in a heterogeneous manner. The inflator 10 was actuated within a 60 L tank and pressure curves over time were evaluated. The total amount of gas produced was 0.3 mols of gas. The tank pressure was about 145 kPa at 15 ms. Examples 7-10 illustrate how increasing the amount of ammonium nitrate and reducing the amount of gas generant results in equivalent amounts of gas albeit at cooler temperatures. As a result, the output gases are cooler and therefore reduce the cooling requirements of the gases. It is believed that the endothermic step in the decomposition of the ammonium nitrate results in a chemical heat sink with the attendant structural advantages in the inflator, including a reduced filter/heat sink size, a reduced inflator size, and an improved packaging size with a reduced weight.

EXAMPLE 11

A first gas generating composition was formed as described in U.S. Pat. No. 5,035,757. A second comparative gas generating composition was formed as described in example 2, and ammonium nitrate as a decomposition additive was scattered and dispersed about the gas generant bed, thereby commingling the second composition and the ammonium nitrate in a heterogeneous manner. Comparable pressure curves were generated, but the inflators differed greatly in size. The first inflator for the first composition required greater cooling because no decomposition additive such as ammonium nitrate was employed. The first inflator weighed 55 grams. The second inflator for the second composition and ammonium nitrate did not require the same cooling for reasons illustrated in the examples given above. The second inflator weighed 22 grams. The gas output for each inflator was approximately equivalent, with an approximate equivalent peak pressure output.

The decomposition additive 26 may be selected from any material that provides the desired amount of gas, and that decomposes at temperatures at or below the combustion temperature of the associated gas generant 22. Exemplary decomposition additives may be selected from ammonium nitrate, azodicarbonamide; biurea; tetrazoles and salts thereof such as 5-aminotetrazole and 5-aminotetrazole nitrate; triazoles; and guanidine nitrate. The mass ratio of the gas generant 22 to the decomposition additive 26, relative to the total mass of both combined, generally ranges from 20:80 to 80:20, and more generally ranges from 40:60 to 60:40. It is emphasized, however, that in accordance with the present invention, any mass ratio resulting in any of the benefits described herein is contemplated.

Figure 2:
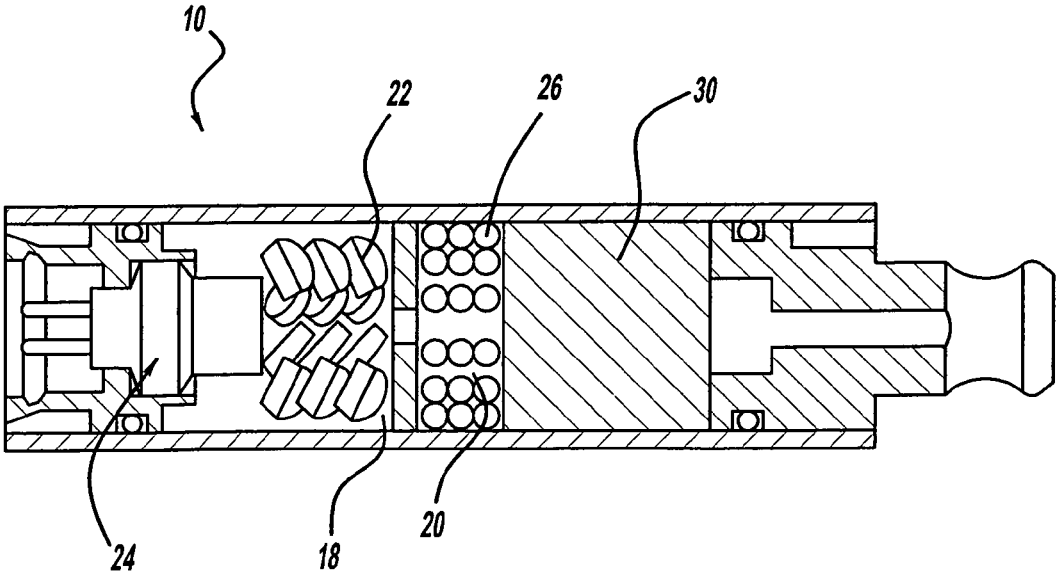
FIG. 2 is a cross-sectional view of a second embodiment of the inflator assembly in accordance with the present invention.

In manufacturing the inflator, the various structural constituents of the gas generator 10 are generally made in a known manner. The gas generating composition 22 may be made as described in Example 2, or in a known manner, and is loaded in a gas generator in a known manner, thereby providing a primary heat source. As shown in FIGS. 1, 2, and 4, the gas generating composition 22 is positioned within a combustion chamber 20. If desired, the decomposition additive 26 may be positioned or juxtaposed to the composition 22, in physical contact with, but in a separate but proximate relationship to the composition 22. Consistent therewith, a discrete and separate additive 26, in the form of a compound or composition, is sprinkled or distributed about the interstitial cavities within the gas generator 10, and/or, about the gas generating composition 22. Consistent with the present invention, the decomposition material or additive 26 is separate from the gas generating composition 22, and does not constitute a fraction or portion of the gas generating composition 22. As shown in FIG. 2, for example, the decomposition material 26 may in fact be housed in a separate decomposition chamber 20. Furthermore, the additive 26 is selected and optimized to ensure that it decomposes rather than combusts at the combustion temperatures attendant to the combustion of the gas generating composition 22, and, that it advantageously liberates generous amounts of gas upon decomposition thereof. It will be appreciated that the combustion properties of the composition 22, and the thermal decomposition properties of the material 26 may either be determined iteratively in a laboratory setting, or, these properties may be established in a known manner, as described in Example 1 for instance.

Figure 3:
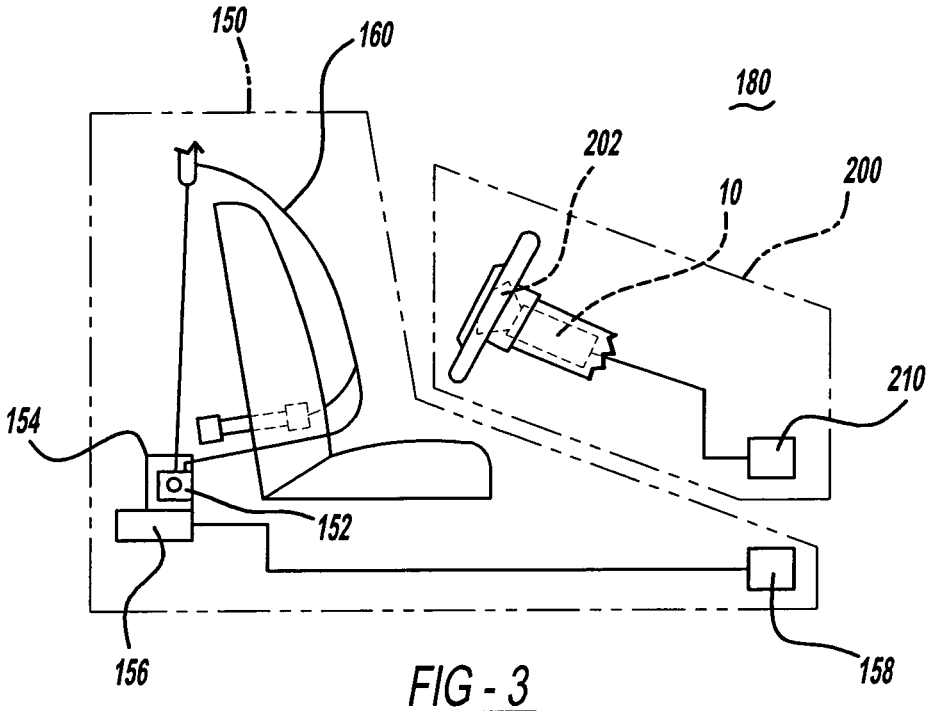
FIG. 3 is a schematic view of a gas generating system and a vehicle occupant restraint system incorporating a gas generator of the present invention.

Referring now to FIG. 3, the exemplary inflator 10 described above may also be incorporated into an airbag system 200. Airbag system 200 includes at least one airbag 202 and an inflator 10 containing a gas generant composition 22 and a decomposition material 26 in accordance with the present invention, coupled to airbag 202 so as to enable fluid communication with an interior of the airbag. Airbag system 200 may also include (or be in communication with) a crash event sensor 210. Crash event sensor 210 includes a known crash sensor algorithm that signals actuation of airbag system 200 via, for example, activation of airbag inflator 10 in the event of a collision.

Referring again to FIG. 3, airbag system 200 may also be incorporated into a broader, more comprehensive vehicle occupant restraint system 180 including additional elements such as a safety belt assembly 150. FIG. 2 shows a schematic diagram of one exemplary embodiment of such a restraint system. Safety belt assembly 150 includes a safety belt housing 152 and a safety belt 100 extending from housing 152. A safety belt retractor mechanism 154 (for example, a spring-loaded mechanism) may be coupled to an end portion of the belt. In addition, a safety belt pretensioner 156 containing propellant 22 and decomposition material 26 may be coupled to belt retractor mechanism 154 to actuate the retractor mechanism in the event of a collision. Typical seat belt retractor mechanisms which may be used in conjunction with the safety belt embodiments of the present invention are described in U.S. Pat. Nos. 5,743,480, 5,553,803, 5,667,161, 5,451,008, 4,558,832 and 4,597,546, incorporated herein by reference. Illustrative examples of typical pretensioners with which the safety belt embodiments of the present invention may be combined are described in U.S. Pat. Nos. 6,505,790 and 6,419,177, incorporated herein by reference.

Safety belt assembly 150 may also include (or be in communication with) a crash event sensor 158 (for example, an inertia sensor or an accelerometer) including a known crash sensor algorithm that signals actuation of belt pretensioner 156 via, for example, activation of a pyrotechnic igniter (not shown) incorporated into the pretensioner. U.S. Pat. Nos. 6,505,790 and 6,419,177, previously incorporated herein by reference, provide illustrative examples of pretensioners actuated in such a manner.

Referring now to FIG. 4, a gas generator 10 in accordance with the present invention incorporates a decomposition chamber 20, also identified as a plenum 30, for containment of the decomposition additive 26. This improvement facilitates separation of the gas generant 22 and the decomposition material 26, should the two materials need to be separated, for reasons of compatibility, for example.

It should be appreciated that gas generator 10, safety belt assembly 150, airbag system 200, and more broadly, vehicle occupant protection system 180 exemplify but do not limit gas generating systems contemplated in accordance with the present invention. The present description is for illustrative purposes only, and should not be construed to limit the breadth of the present invention in any way. Thus, those skilled in the art will appreciate that various modifications could be made to the presently disclosed embodiments without departing from the intended spirit and scope of the present invention. Other aspects, features and advantages will be apparent upon an examination of the attached drawing figures and appended claims.

What is claimed is:

1. A gas generating system comprising:

a gas generator containing a housing;

a gas generating composition contained within a gas generant bed within said housing, said gas generator having a predetermined combustion temperature, and a predetermined heat of combustion; and a separate decomposition additive in thermodynamic communication with said gas generating composition upon actuation of said gas generator, said decomposition additive commingled about said gas generating composition in physical, proximate, and discrete relationship to said gas generating composition, said decomposition additive selected from the group consisting of ammonium nitrate, guanidine nitrate, azodicarbonamide, biurea, tetrazoles, salts of tetrazoles, and triazoles, said decomposition additive decomposing at a temperature at or below the combustion temperature of said gas generant, wherein said gas generating composition consists of:

a primary fuel selected from the group consisting of tetrazoles, a benzene-based fuel, dinitrobenzamide, and nitroisophthalic acid, and mixtures thereof;

an aromatic or non-aromatic basic constituent selected from the group consisting of amino compounds, salts of amino compounds, alkali metal salts, and mixtures thereof;

an oxidizer selected from the group consisting of metallic oxidizers; and an additive selected from the group consisting of catalytic non-oxidizing molybdenum-containing constituents.

2. The gas generating system of claim 1 wherein said primary fuel is selected from the group consisting of 5-aminotetrazole, dinitrobenzoic acid, dinitrobenzamide, and nitroisophthalic acid, and mixtures thereof.

3. The gas generating system of claim 1 wherein said aromatic or non-aromatic basic constituent is selected from the group consisting of potassium 5-aminotetrazole, sodium 5-aminotetrazole, and potassium dinitrobenzoate, and mixtures thereof.

4. The gas generating system of claim 1 wherein said oxidizer is selected from the group consisting of alkali metal oxidizers.

5. The gas generating system of claim 4 wherein said oxidizer is selected from the group consisting of potassium nitrate, sodium nitrate, and mixtures thereof.

6. The gas generating system of claim 1 wherein said additive is selected from the group consisting of molybdenum, molybdenum trioxide, and mixtures thereof.

7. The gas generating system of claim 1 wherein said primary fuel is provided at about 1-50 weight percent, said basic constituent is provided at about 1-50 weight percent, said oxidizer is provided at about 35-75 weight percent, and, said additive is provided at about 1-10 weight percent, said percents taken with respect to the total weight of said gas generating composition.

8. The gas generating system of claim 1 wherein said decomposition additive is selected from the group consisting of 5-aminotetrazole and 5-aminotetrazole nitrate.

9. The gas generating system of claim 1 wherein said gas generating composition and said decomposition additive are provided in a weight ratio ranging from 20-80 weight percent of said gas generating composition to 80-20 weight percent of said decomposition additive.

10. The gas generating system of claim 1 wherein said gas generating composition and said decomposition additive are provided in a weight ratio ranging from 40-60 weight percent of said gas generating composition to 60-40 weight percent of said decomposition additive.

11. The gas generating system of claim 1 wherein said decomposition additive is distributed about the gas generating composition in physical contact therewith, in a separate but proximate relationship to said gas generating composition.

12. The gas generating system of claim 1 wherein said decomposition additive is housed in a chamber separate from said gas generating composition but in thermodynamic communication therewith.

13. A gas generating system comprising:

a gas generator containing a housing;

a gas generating composition contained within said housing, said gas generator having a predetermined combustion temperature, and a predetermined heat of combustion, and, said gas generating composition consisting of a primary fuel selected from the group consisting of tetrazoles, a benzene-based fuel, dinitrobenzamide, and nitroisophthalic acid, and mixtures thereof; an aromatic or non-aromatic basic constituent selected from the group consisting of amino compounds, salts of amino compounds, alkali metal salts, and mixtures thereof; an oxidizer selected from the group consisting of metal oxidizers; and an additive selected from the group consisting of catalytic non-oxidizing molybdenum-containing constituents; and a decomposition additive in thermodynamic communication with said gas generating composition upon actuation of said gas generator, said decomposition additive selected from the group consisting of ammonium nitrate, guanidine nitrate, azodicarbonamide, biurea, tetrazoles, salts of tetrazoles, and triazoles, said decomposition additive decomposing at a temperature at or below the combustion temperature of said gas generant, wherein said decomposition additive is housed in a chamber separate from said gas generating composition but in thermodynamic communication therewith.

14. A gas generating system comprising:

a gas generator containing a housing;

a gas generating composition contained within said housing, said gas generator having a predetermined combustion temperature, and a predetermined heat of combustion; and, a decomposition additive in thermodynamic communication with said gas generating composition upon actuation of said gas generator, said decomposition additive decomposing at a temperature at or below the combustion temperature of said gas generant and said decomposition additive sprinkled and commingled about said gas generating composition in proximate but separate and discrete relationship to said gas generating composition, and, said decomposition additive selected from ammonium nitrate, guanidine nitrate, azodicarbonamide, biurea, tetrazoles, salts of tetrazoles, and triazoles, wherein said gas generating composition consists of:

a primary fuel selected from the group consisting of benzene-based fuels, dinitrobenzamide, and nitroisophthalic acid, and mixtures thereof;

an aromatic or non-aromatic basic constituent selected from the group consisting of amino compounds, salts of amino compounds, and mixtures thereof;

an oxidizer selected from the group consisting of metallic oxidizers; and an additive selected from the group consisting of catalytic non-oxidizing molybdenum-containing constituents.

15. The gas generating system of claim 14 wherein said decomposition additive is ammonium nitrate.

16. The gas generating system of claim 1 wherein said gas generating composition is in tablet form.

* * * * *